US010253589B2

(12) United States Patent
Helvenston et al.

(10) Patent No.: US 10,253,589 B2
(45) Date of Patent: Apr. 9, 2019

(54) OFFSET ADJUSTMENT RINGS FOR WELLHEAD ORIENTATION

(71) Applicant: GE Oil & Gas Pressure Control LP, Houston, TX (US)

(72) Inventors: Andrew Browne Helvenston, Houston, TX (US); Eugene Allen Borak, Houston, TX (US); Khang V. Nguyen, Houston, TX (US); Ryan Joseph Parsley, Houston, TX (US)

(73) Assignee: GE Oil & Gas Pressure Control LP, Houston, TX (US)

( * ) Notice: Subject to any disclaimer, the term of this patent is extended or adjusted under 35 U.S.C. 154(b) by 294 days.

(21) Appl. No.: 15/201,957

(22) Filed: Jul. 5, 2016

(65) Prior Publication Data

US 2017/0009539 A1 Jan. 12, 2017

Related U.S. Application Data

(60) Provisional application No. 62/188,871, filed on Jul. 6, 2015.

(51) Int. Cl.

| | |
|---|---|
| ***E21B 33/04*** | (2006.01) |
| ***E21B 33/03*** | (2006.01) |
| ***E21B 19/24*** | (2006.01) |

(52) U.S. Cl.

CPC ..... *E21B 33/04* (2013.01); *E21B 19/24* (2013.01); *E21B 33/03* (2013.01); *E21B 33/0422* (2013.01)

(58) Field of Classification Search

CPC ..... E21B 19/24; E21B 33/03; E21B 33/0422; E21B 33/04

See application file for complete search history.

(56) References Cited

U.S. PATENT DOCUMENTS

| | | | | |
|---|---|---|---|---|
| 1,548,543 | A | 8/1925 | Moody | |
| 2,179,814 | A | 11/1939 | Conaghan | |
| 4,771,832 | A | 9/1988 | Bridges | |
| 7,562,701 | B2 | 7/2009 | Lacusta et al. | |
| 8,307,889 | B2 * | 11/2012 | Lewkoski | E21B 33/00 166/380 |
| 2011/0278023 | A1 | 11/2011 | Lewkoski | |

OTHER PUBLICATIONS

PCT Search Report and Written Opinion issued in connection with Corresponding Application No. PCT/US2016/041130 dated Nov. 2, 2016.

* cited by examiner

*Primary Examiner* — Michael R Wills, III

(74) *Attorney, Agent, or Firm* — Hogan Lovells US LLP

(57) ABSTRACT

Systems and methods for positioning tubular members within a subterranean well include inner and outer tubular members extending into the well. An adjustment ring assembly is located between the inner tubular member and the outer tubular member and has an outer ring and an inner ring. The outer ring circumscribes, and is rotatable relative to, the inner ring to adjust the radial offset between a central axis of the wellhead assembly and a central axis of the inner tubular member.

20 Claims, 2 Drawing Sheets

OFFSET ADJUSTMENT RINGS FOR WELLHEAD ORIENTATION

CROSS REFERENCE TO RELATED APPLICATION

This application claims priority to and the benefit of U.S. Provisional Application Ser. No. 62/188,871, filed Jul. 6, 2015, titled "Offset Adjustment Rings For Wellhead Orientation," the full disclosure of which is hereby incorporated herein by reference in its entirety for all purposes.

BACKGROUND

1. Field of the Disclosure

The present disclosure relates to assemblies used in hydrocarbon drilling and production operations, and in particular, to the alignment of tubular members of such assemblies.

2. Description of Related Art

There may be times when it would be preferred for some tubular members used in hydrocarbon drilling and production operations that extend within other tubular members, to not share a common centerline or axis with other such tubular members. As an example, if a rig is not centered over an already drilled well with a conductor, it could be a challenge to perform functions through a wellhead assembly that is centered over the conductor because the conductor would not be directly aligned with the block or rotary table or the rig. When the existing drilled hole or equipment is off center, it becomes more difficult to run equipment straight down the hole or on top of the existing equipment.

SUMMARY OF THE DISCLOSURE

In order to align the wellhead assembly with the block or rotary table of the rig when the conductor is offset from the block or rotary table of the rig, the wellhead assembly can be landed on the conductor in a location that is aligned with the rig but offset from the central axis of the conductor. Embodiments of this disclosure provide systems and methods that include an adjustment ring assembly that can provide for offset between an outer tubular member and an inner tubular member that extends through the bore of the outer tubular member. The adjustment ring assembly allows for the use of standard currently available locking mechanisms and seals. For example, seals and locking mechanisms between an outer surface of the adjustment ring assembly and an inner diameter of the outer tubular member, as well as seals and locking mechanisms between an inner diameter of the adjustment ring assembly and the outer diameter of the inner tubular member can be standard annular seals and locking mechanisms.

In an embodiment of the current disclosure, a system for positioning tubular members within a subterranean well includes a wellhead assembly located over a well. An outer tubular member extends into the well. An inner tubular member extends within the outer tubular member. An adjustment ring assembly circumscribes the inner tubular member and is located between the inner tubular member and the outer tubular member. The adjustment ring assembly has an outer ring with an outer ring exterior circumference in cross section that is bisected by an outer ring exterior circumference bisecting line. The outer ring also has an outer ring interior circumference in cross section that is bisected by an outer ring interior circumference bisecting line that is parallel to, and offset from, the outer ring exterior circumference bisecting line. The adjustment ring further includes an inner ring with an inner ring exterior circumference in cross section that is bisected by an inner ring exterior circumference bisecting line. The inner ring has an inner ring interior circumference in cross section that is bisected by an inner ring interior circumference bisecting line that is parallel to, and offset from, the outer ring exterior circumference bisecting line. The outer ring circumscribes, and is rotatable relative to, the inner ring.

In an alternate embodiment of this disclosure, a system for positioning tubular members within a subterranean well includes a wellhead assembly located over a well. An outer tubular member extends into the well. An inner tubular member extends within the outer tubular member, wherein a central axis of the inner tubular member is radially offset from a central axis of the outer tubular member. An adjustment ring assembly circumscribes the inner tubular member and is located between the inner tubular member and the outer tubular member. The adjustment ring assembly has an outer ring with an outer ring exterior surface that engages the outer tubular member. The adjustment ring assembly also has an inner ring with an inner ring interior surface that engages the inner tubular member. The outer ring circumscribes, and is rotatable relative to, the inner ring.

In yet another alternate embodiment of this disclosure, a method for positioning tubular members within a subterranean well includes lowering a wellhead assembly over a well, the well having an outer tubular member extending into the well, and providing an adjustment ring assembly within the outer tubular member. An inner tubular member is extended into the outer tubular member so that the adjustment ring assembly is located between the inner tubular member and the outer tubular member and the adjustment ring assembly circumscribes the inner tubular member. The adjustment ring assembly has an outer ring with an outer ring exterior circumference in cross section that is bisected by an outer ring exterior circumference bisecting line, and an outer ring interior circumference in cross section that is bisected by an outer ring interior circumference bisecting line that is parallel to, and offset from, the outer ring exterior circumference bisecting line. The adjustment ring assembly also has an inner ring with an inner ring exterior circumference in cross section that is bisected by an inner ring exterior circumference bisecting line, and an inner ring interior circumference in cross section that is bisected by an inner ring interior circumference bisecting line that is parallel to, and offset from, the outer ring exterior circumference bisecting line. The outer ring circumscribes, and is rotatable relative to, the inner ring to adjust a radial offset between a central axis of the wellhead assembly and a central axis of the inner tubular member.

BRIEF DESCRIPTION OF DRAWINGS

Some of the features and benefits of the present disclosure having been stated, others will become apparent as the description proceeds when taken in conjunction with the accompanying drawings, in which.

Figure 1:
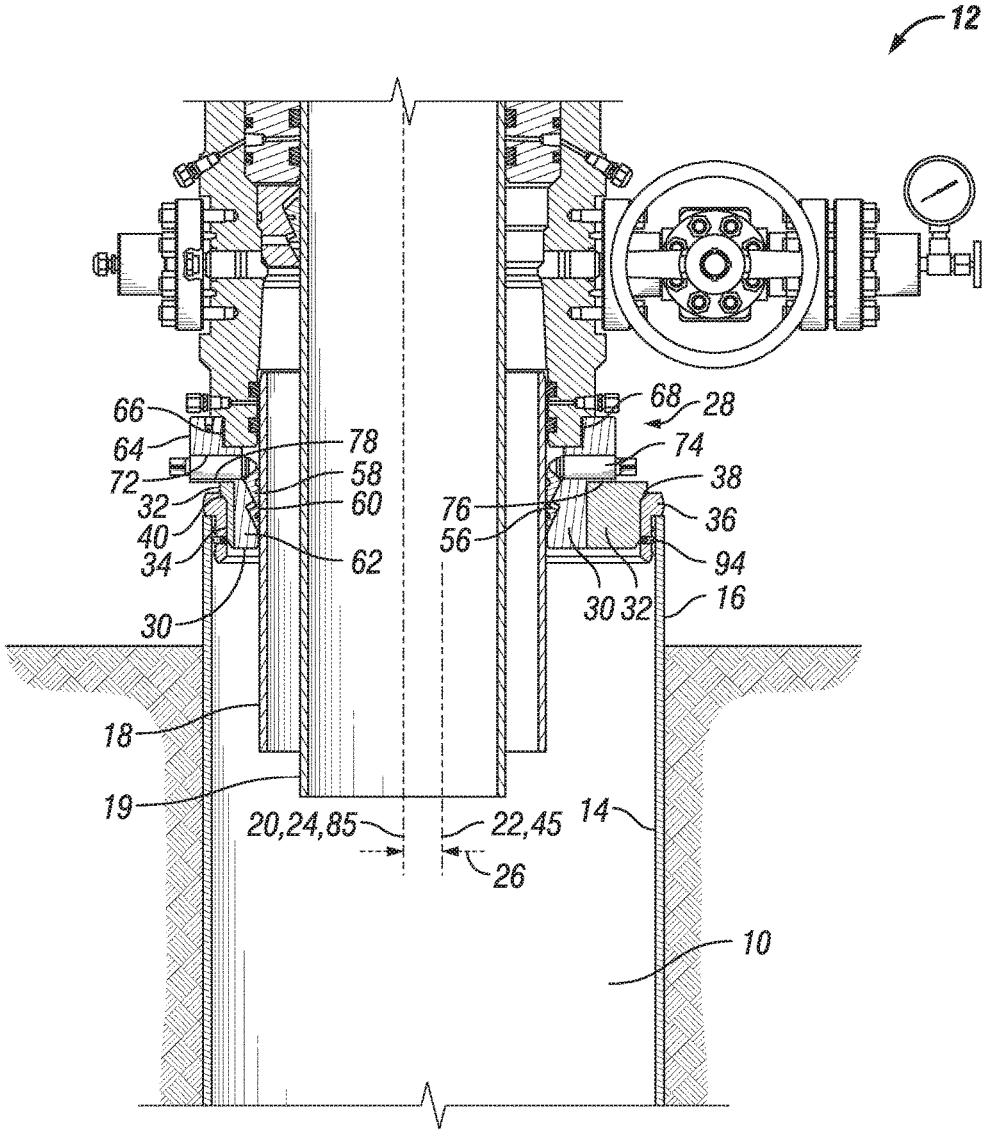
FIG. 1 is a section view of an offset wellhead assembly with an adjustment ring assembly in accordance with an embodiment of this disclosure.

While the disclosure will be described in connection with the example embodiments, it will be understood that it is not intended to limit the disclosure to that embodiment. On the contrary, it is intended to cover all alternatives, modifications, and equivalents, as may be included within the spirit and scope of the disclosure as defined by the appended claims.

DETAILED DESCRIPTION OF DISCLOSURE

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, well 10 has a wellhead assembly 12 located at an upper end of wellbore 14 of well 10 and positioned over well 10. Conductor 16 and casing 18 extend downward from wellhead assembly 12 into well 10. Conductor 16 can be a tubular member that supports wellhead assembly 12 over well 10. Casing 18 extends within conductor 16. Casing 18 is an elongated tubular member and can be supported by conductor 16 or wellhead assembly 12. In embodiments, such as that of FIG. 1, there can be more than one string of casing 18, such as second casing 19, and each string of casing can extend within conductor 16.

Figure 2:
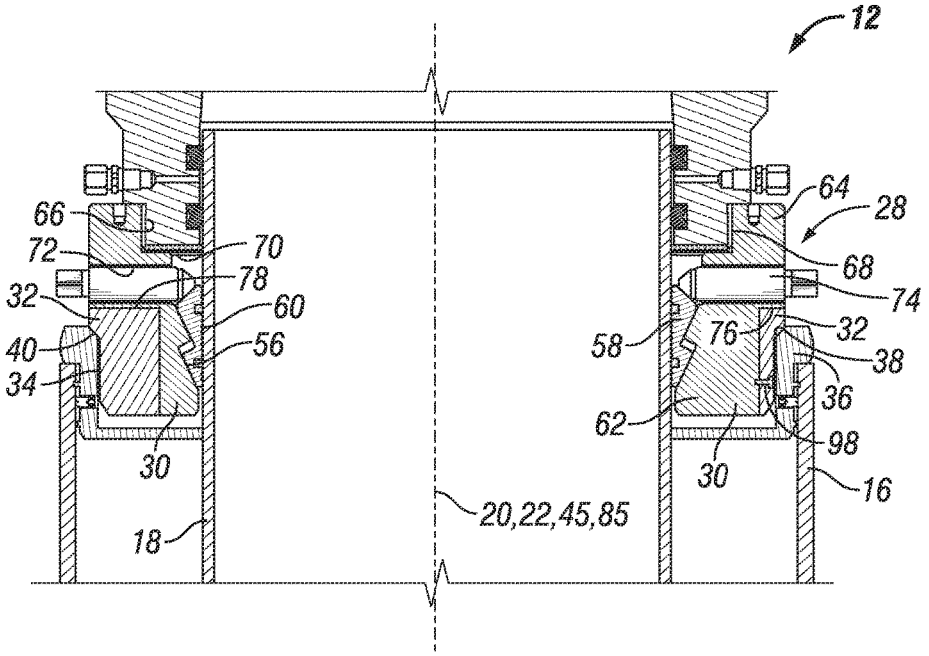
FIG. 2 is a section view of a portion of a non-offset wellhead assembly with an adjustment ring assembly in accordance with an embodiment of this disclosure.

In the example of FIGS. 1-2, conductor 16 is considered the outer tubular member and outermost casing 18 is considered the inner tubular member. In alternate embodiments, the outer tubular member and the inner tubular member can both be one of the casings 18. In other alternate embodiments, the outer tubular member and the inner tubular member can be hangers or other known tubular members that can extend into well 10.

Casing 18 can extend into conductor 16 with a central axis 20 of casing 18 that is radially offset from a central axis 22 of conductor 16 (FIG. 1). Alternately, casing 18 can extend into conductor 16 with central axis 20 of casing 18 that is coaxial with central axis 22 of conductor 16 (FIG. 2). Central axis 24 of wellhead assembly 12 in each example embodiment of FIGS. 1-2 is aligned coaxially with central axis 20 of casing 18. Radial offset 26 is the radial distance between central axis 20 of casing 18 and central axis 22 of conductor 16. Because central axis 24 of wellhead assembly 12 is coaxial with central axis 20 of casing 18, radial offset 26 is also the radial distance between central axis 24 of wellhead assembly 12 and central axis 22 of conductor 16. In the example embodiment of FIG. 2, since central axis 20 of casing 18 is coaxial with central axis 22 of conductor 16, there is no radial offset 26. In other words, the radial offset is zero. The example of FIG. 1 shows a maximum radial offset 26. In accordance with embodiments of this disclosure, radial offset 26 can have any value between zero (FIG. 2) and the maximum radial offset 26 shown in FIG. 1. Adjustment ring assembly 28 can be used to provide the maximum radial offset 26 of FIG. 1 and the zero radial offset of FIG. 2.

Looking at FIG. 1, adjustment ring assembly 28 circumscribes casing 18 and is located between casing 18 and conductor 16 to provide for a range of positioning of casing 18 within conductor 16. Adjustment ring assembly 28 includes inner ring 30 and outer ring 32. In alternate embodiments, adjustment ring assembly 28 can include additional rings so that adjustment ring assembly 28 includes inner ring 30, outer ring 32 and one or more additional rings radially exterior to outer ring 32 or radially interior to inner ring 30.

Outer ring 32 circumscribes inner ring 30 and is rotatable relative to inner ring 30. Outer ring 32 has outer ring exterior surface 34 that engages conductor 16. In the example of FIG. 1, outer ring exterior surface 34 engages conductor 16 by way of landing ring 36. Landing ring 36 can have the design and function of a common landing ring known in the art. In the example orientation of FIG. 1, landing ring 36 has a downward facing shoulder that sits on a top end of conductor 16. Landing ring 36 can be installed on conductor 16 with set screws or with other known connection means. Landing ring 36 has a load shoulder 38 that is a generally upward facing sloped shoulder. Mating shoulder 40 of outer ring 32 is a generally downward facing sloped shoulder that lands on load shoulder 38. In alternate embodiments, outer ring 32 can be integrally formed with landing ring 36 or conductor 16.

Figure 3A:
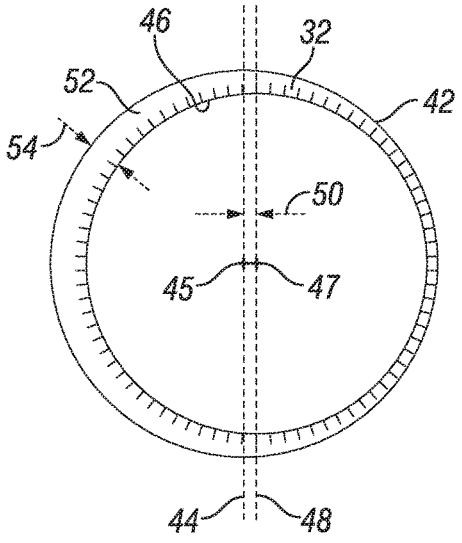
FIG. 3A is a bottom view of the outer ring of the adjustment ring assembly in accordance with an embodiment of this disclosure.

Looking at FIG. 3A, outer ring 32 has exterior circumference 42 in cross section that is circular. Outer ring 32 exterior circumference 42 is bisected by outer ring exterior circumference bisecting line 44. Central axis 45 of exterior circumference 42 of outer ring 32 is located along outer ring exterior circumference bisecting line 44. In FIGS. 1 and 2, central axis 45 of the exterior circumference 42 of outer ring 32 is coaxial with central axis 22 of conductor 16.

Outer ring 32 has interior circumference 46 in cross section that is circular. Outer ring 32 interior circumference 46 is bisected by outer ring interior circumference bisecting line 48. Outer ring exterior circumference bisecting line 44 is parallel to, and offset from, outer ring interior circumference bisecting line 48. Central axis 47 of interior circumference 46 of outer ring 32 is located along outer ring interior circumference bisecting line 48.

Outer ring offset 50 is the radial distance between outer ring exterior circumference bisecting line 44 and outer ring interior circumference bisecting line 48. Outer ring offset 50 is also the radial distance between central axis 45 of the exterior circumference 42 of outer ring 32 and central axis 47 of interior circumference 46 of outer ring 32. Outer ring offset 50 is the result of sidewall 52 of outer ring 32 varying in radial thickness 54 around outer ring 32. In this application, the term "bisected" means that the circular shape is divided in two equal halves.

Looking at FIG. 1, inner ring 30 has an inner ring interior surface 56 that engages casing 18. In the example of FIG. 1, inner ring interior surface 56 engages casing 18 by way of slips 58. Slips 58 can have the design and function of common slips known in the art. In the example orientation of FIG. 1, slips 58 has a gripping surface 60 for engaging the outer diameter of casing 18 and supporting casing 18 within well 10. Inner ring 30 has a variable or lower portion 62 that provides the offsetting function of adjustment ring assembly 28. Interior surface 56 of lower portion 62 of inner ring 30, when viewed as an elevation section view (such as shown in FIG. 1), includes a profiled surface with one or more generally upward facing sloped shoulders that engage an outer diameter of slips 58. The shape of the generally upward facing sloped shoulders of interior surface 56 of inner ring 30 urge slips 58 radially inward as the weight of casing 18 is suspended from slips 58 so that the ability of gripping surface 60 to support casing 18 is increased.

Inner ring 30 has upper portion 64 that is axially above lower portion 62. Upper portion 64 has a larger outer diameter than lower portion 62 and has inner diameter surfaces and outer diameter surfaces that have a common central axis that is coaxial with wellhead assembly 12 when wellhead assembly 12 is mounted on conductor 16. Upper portion 64 has annular groove 66 located on an inner diameter of upper portion 64. Annular groove 66 can be sized to accept a lower end of wellhead assembly 12. The lower end of wellhead assembly 12 can be releasably secured to adjustment ring assembly 28. In the example of FIG. 1, the lower end of wellhead assembly 12 is threaded in annular groove 66 through threaded connection 68. In order to enable proper alignment of wellhead assembly 12 relative to adjustment ring assembly 28, shims 70 (FIG. 2) can be placed between a surface of adjustment ring assembly 28 and a surface of wellhead assembly 12. The thickness of shims 70 can be selected so that wellhead assembly 12 is secured to adjustment ring assembly 28 at the desired axial location.

Upper portion 64 also includes openings 72 that extend radially through upper portion 64. Locking dogs 74 can extend through openings 72 and engage shims 70. Locking dogs 74 retain shims 70 so that casing 18 remains secured to adjustment ring assembly 28. Locking dogs 74 can have the design and function of locking dogs known in the art. In alternate embodiments, other known connection and locking means can be used to releasably secure adjustment ring assembly 28 to casing 18. Upper portion 64 further includes downward facing shoulder 76 that is supported by upper surface 78 of outer ring 32. The weight of wellhead assembly 12, including the weight of tubular or other members suspended from wellhead assembly 12, can cause adjustment ring assembly 28 to remain in engagement with conductor 16. In alternate embodiments, Adjustment ring assembly 28 can remain in engagement with conductor 16 by known connection or locking means between outer ring 32 and conductor 16.

Figure 3B:
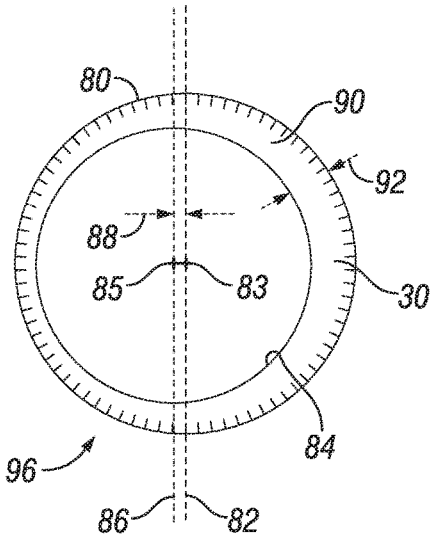
FIG. 3B is a bottom view of the inner ring of the adjustment ring assembly in accordance with an embodiment of this disclosure.

Looking at FIG. 3B, inner ring 30 has exterior circumference 80 in cross section that is circular. Inner ring 30 exterior circumference 80 is bisected by inner ring exterior circumference bisecting line 82. Central axis 83 of exterior circumference 80 of inner ring 30 is located along inner ring exterior circumference bisecting line 82.

Inner ring 30 has interior circumference 84 in cross section that is circular. Inner ring 30 interior circumference 84 is bisected by inner ring interior circumference bisecting line 86. Central axis 85 of interior circumference 84 of inner ring 30 is located along inner ring interior circumference bisecting line 86. In FIGS. 1 and 2, central axis 85 of interior circumference 84 of inner ring 30 is coaxial with central axis 20 of casing 18.

Inner ring exterior circumference bisecting line 82 is parallel to, and offset from, inner ring interior circumference bisecting line 86. Inner ring offset 88 is the radial distance between inner ring exterior circumference bisecting line 82 and inner ring interior circumference bisecting line 86. Inner ring offset 88 is also the radial distance between central axis 483 of the exterior circumference 80 of inner ring 30 and central axis 85 of interior circumference 84 of inner ring 30. Inner ring offset 88 is the result of sidewall 90 of inner ring 30 varying in radial thickness 92 around inner ring 30.

Looking at FIG. 1, in certain embodiments, a sealing arrangement between casing 18 and conductor 16 can prevent well fluids from escaping from between casing 18 and conductor 16. The sealing arrangement can include a seal 94 between conductor 16 and landing ring 36, between landing ring 36 and outer ring 32, between outer ring 32 and inner ring 30, and between inner ring 30 and casing 18. In this way, adjustment ring assembly 28 sealingly engages casing 18 and sealingly engages conductor 16.

With inner ring 30 nested within outer ring 32, inner ring 30 or outer ring 32 can be rotated relative to the other so that the position of the central axis 85 of interior circumference 84 of inner ring 30 can be adjusted relative to central axis 45 of the exterior circumference 42 of outer ring 32. Looking at the example of FIG. 1, in order to achieve maximum offset between the central axis 85 of interior circumference 84 of inner ring 30 and central axis 45 of the exterior circumference 42 of outer ring 32, the widest part of sidewall 52 of outer ring 32 can be located adjacent to the widest part of sidewall 90 of inner ring 30 (right side of FIG. 1). This will result in the narrowest part of sidewall 52 of outer ring 32 being located adjacent to the narrowest part of sidewall 90 of inner ring 30 (left side of FIG. 1).

Alternately, looking at the example of FIG. 2, in order to achieve minimum offset between central axis 85 of interior circumference 84 of inner ring 30 and central axis 45 of the exterior circumference 42 of outer ring 32, the widest part of sidewall 52 of outer ring 32 can be located adjacent to the narrowest part of sidewall 90 of inner ring 30 (left side of FIG. 2). This will result in the narrowest part of sidewall 52 of outer ring 32 being located adjacent to the widest part of sidewall 90 of inner ring 30 (right side of FIG. 2). If outer ring offset 50 and inner ring offset 88, as shown in FIG. 3, are equal in distance, aligning outer 32 and inner ring 30 as shown in FIG. 2, will result in central axis 20 of casing 18 being coaxial with central axis 22 of conductor 16. In such an embodiment, this common central axis will also be the central axis of central axis 45 of exterior circumference 42 of outer ring 32 and central axis 85 of interior circumference 84 of inner ring 30.

In other alternate embodiments, inner ring 30 can be adjusted relative to outer ring 32 so that the offset between central axis 85 of interior circumference 84 of inner ring 30 and central axis 45 of the exterior circumference 42 of outer ring 32 will have a value between the minimum offset amount and the maximum offset amount.

In the embodiments shown in FIGS. 1-2, regardless of the relative rotational relationship between inner ring 30 and outer ring 32, central axis 85 of interior circumference 84 of inner ring 30 is coaxial with central axis 20 of casing 18 and central axis 24 of wellhead assembly 12, and central axis 45 of the exterior circumference 42 of outer ring 32 is coaxial with central axis 22 of conductor 16. Therefore, in order to set the desired relative positions between central axis 20 of casing 18 and central axis 22 of conductor 16, adjustment ring assembly 28 can include clocking mechanism 96. Clocking mechanism 96 can provide the value of offset between based on a relative rotation between inner ring 30 and outer ring 32. Clocking mechanism 96 can include a series of identifying marks around surfaces of inner ring 30 and outer ring 32, such as the bottom of inner ring 30 and outer ring 32 as shown in FIGS. 3A-3B, that can be aligned to arrive at the desired offset. In alternate embodiments, clocking mechanism can include a separate tool that measures rotation or distances. In order to adjust the rotational alignment of inner ring 30 relative to outer ring 32, an operator can manually rotate inner ring 30 relative to outer ring 32 or can rotate outer ring 32 relative to inner ring 30 until the desired offset value is obtained. In alternate embodiments, the rotational alignment of inner ring 30 relative to outer ring 32 in order to arrive at the desired offset value can be automated.

After the desired offset amount has been established, locking mechanism 98 can be used to limit relative rotational or axial movement between inner ring 30 and outer ring 32. In the example embodiment shown, locking mechanism 98 is a set screw that extends through outer ring 32 and into inner ring 30. In alternate embodiments, locking mechanism 98 can take on a form of a locking mechanism known in the art. In other alternate embodiments, locking mechanism 98 can additionally or alternately be used between inner ring 30 and casing 18, between outer ring 32 and conductor 16, between outer ring 32 and landing ring 36 and between landing ring 36 and conductor 16.

In an example of operation, wellhead assembly 12 can be assembled in the usual manner known in the art. A desired offset between central axis 20 of casing 18 and central axis 22 of conductor 16 can be determined. Inner ring 30 and outer ring 32 can be rotated relative to each other to arrive at the desired offset.

Wellhead assembly 12 can then be lowered onto conductor 16. Conductor 16 can have a traditional load shoulder that mates with and supports mating shoulder 40 of outer ring 32. In this way, adjustment ring assembly 28 can be used with currently available well development equipment without modification to such equipment. Commonly known and readily available annular seals and locking mechanisms, such as those shown in FIGS. 1-2, can be used to seal and secure wellhead assembly 12 over well 10. Casing 18 can be lowered through wellhead assembly 12 and supported by slips 58 in a traditional manner.

Although the example uses of adjustment ring assembly 28 described herein are related to wellhead assemblies an conductors being offset from casing, embodiments of adjustment ring assembly 28 described herein can also be used to offset other tubular members used in hydrocarbon drilling and production operations, such as with casing, hangers, and other tubular member used and known in the art.

Where reference is made to a method comprising two or more defined steps, the defined steps can be carried out in any order or simultaneously except where the context excludes that possibility. The terms "vertical", "horizontal", "upward", "downward", "above", and "below" and similar spatial relation terminology are used herein only for convenience because elements of the current disclosure may be installed in various relative positions.

The present disclosure described herein, therefore, is well adapted to carry out the objects and attain the ends and advantages mentioned, as well as others inherent therein. While example embodiments of the disclosure have been given for purposes of disclosure, numerous changes exist in the details of procedures for accomplishing the desired results. These and other similar modifications will readily suggest themselves to those skilled in the art, and are intended to be encompassed within the spirit of the present disclosure disclosed herein and the scope of the appended claims.

What is claimed is:

1. A system for positioning tubular members within a well, the system comprising:

an outer tubular member extending into the well;

an inner tubular member extending within the outer tubular member;

an adjustment ring assembly circumscribing the inner tubular member and located within the outer tubular member, wherein the adjustment ring assembly has:

an outer ring with an outer ring exterior circumference having a first central axis, and an outer ring interior circumference having a second central axis offset from the first central axis; and an inner ring with an inner ring exterior circumference having a third central axis, and an inner ring interior circumference having a fourth central axis offset from the third central axis; wherein the outer ring circumscribes, and is rotatable relative to, the inner ring.

2. The system of claim 1, further comprising a wellhead assembly located over the well, wherein a central axis of the wellhead assembly is coaxial with a central axis of the inner tubular member.

3. The system of claim 2, wherein the wellhead assembly is releasably secured to the adjustment ring assembly.

4. The system of claim 1, wherein a central axis of the wellhead assembly is radially offset from a central axis of the outer tubular member.

5. The system of claim 1, wherein an outer ring exterior surface engages the outer tubular member and an inner ring interior surface engages the inner tubular member.

6. The system of claim 1, wherein the first central axis is coaxial with a central axis of the outer tubular member and the third central axis is coaxial with a central axis of the inner tubular member.

7. The system of claim 1, wherein a sidewall of the inner ring varies in radial thickness and a sidewall of the outer ring varies in radial thickness.

8. The system of claim 1, further including a clocking mechanism measuring an offset between a central axis of the inner tubular member and a central axis of the outer tubular member based on a relative rotation between in the inner ring and the outer ring.

9. The system of claim 1, wherein the outer tubular member is a conductor and the inner tubular member is a casing.

10. The system of claim 1, wherein the adjustment ring assembly sealingly engages the inner tubular member and sealingly engages the outer tubular member.

11. The system of claim 1, further comprising a locking mechanism limiting relative movement and located between at least one selected from the group consisting of:

the outer tubular member and the outer ring;

the outer ring and the inner ring; and the inner ring and the inner tubular member.

12. A system for positioning tubular members within a well, the system comprising:

an outer tubular member extending into the well;

an inner tubular member extending within the outer tubular member, and wherein a central axis of the inner tubular member is radially offset from a central axis of the outer tubular member;

an adjustment ring assembly circumscribing the inner tubular member and located within the outer tubular member, wherein the adjustment ring assembly has:

an outer ring with an outer ring exterior surface that engages the outer tubular member; and an inner ring with an inner ring interior surface that engages the inner tubular member; wherein the outer ring circumscribes, and is rotatable relative to, the inner ring.

13. The system of claim 12, further comprising a wellhead assembly located over the well, wherein a central axis of the wellhead assembly is coaxial with the central axis of the inner tubular member and the central axis of the wellhead assembly is radially offset from the central axis of the outer tubular member.

14. The system of claim 12, wherein a central axis of an outer ring exterior circumference is coaxial with the central axis of the outer tubular member and a central axis of an inner ring interior circumference is coaxial with the central axis of the inner tubular member.

15. A method for positioning tubular members within a subterranean well, the method comprising:

lowering a wellhead assembly over a well, the well having an outer tubular member extending into the well and providing an adjustment ring assembly within the outer tubular member;

extending an inner tubular member into the outer tubular member so that the adjustment ring assembly is located between the inner tubular member and the outer tubular member and the adjustment ring assembly circumscribes the inner tubular member, the adjustment ring assembly having:

an outer ring with an outer ring exterior circumference in cross section that is bisected by an outer ring exterior circumference bisecting line, and an outer ring interior circumference in cross section that is bisected by an outer ring interior circumference bisecting line that is parallel to, and offset from, the outer ring exterior circumference bisecting line; and an inner ring with an inner ring exterior circumference in cross section that is bisected by an inner ring exterior circumference bisecting line, and an inner ring interior circumference in cross section that is bisected by an inner ring interior circumference bisecting line that is parallel to, and offset from, the outer ring exterior circumference bisecting line; and wherein the outer ring circumscribes, and is rotatable relative to, the inner ring to adjust a radial offset between a central axis of the wellhead assembly and a central axis of the inner tubular member.

16. The method of claim 15, further comprising engaging the outer tubular member with an outer ring exterior surface and engaging the inner tubular member with an inner ring interior surface.

17. The method of claim 15, further comprising aligning the inner ring and the outer ring of the adjustment ring assembly such that a central axis of the outer ring exterior circumference is coaxial with a central axis of the outer tubular member and a central axis of the inner ring interior circumference is coaxial with a central axis of the inner tubular member.

18. The method of claim 15, further comprising releasably securing the wellhead assembly to the adjustment ring assembly.

19. The method of claim 15, further comprising measuring an offset between a central axis of the inner tubular member and a central axis of the outer tubular member with a clocking mechanism.

20. The method of claim 15, further comprising securing the adjustment ring assembly to the wellhead assembly before lowering the wellhead assembly over the well and landing the wellhead assembly onto the outer tubular member.

* * * * *